United States Patent [19]

McElroy

[11] Patent Number: 4,901,881

[45] Date of Patent: Feb. 20, 1990

[54] METHOD AND APPARATUS FOR CLOSING CONTAINERS

[76] Inventor: Steven G. McElroy, 2500 Enfield, No. 3, Austin, Tex. 78703

[21] Appl. No.: 244,626

[22] Filed: Sep. 12, 1988

Related U.S. Application Data

[63] Continuation of Ser. No. 107,371, Oct. 9, 1987, abandoned.

[51] Int. Cl.[4] ..... B65D 51/00

[52] U.S. Cl. ..... 220/287; 215/1 A; 215/319

[58] Field of Search ..... 220/287, 356; 215/317, 215/319, 1 A; 150/52 R; 229/103.1

[56] References Cited

U.S. PATENT DOCUMENTS

| | | | |
|---|---|---|---|
| 291,022 | 1/1884 | Beaupied . | |
| 644,680 | 3/1900 | Ordway . | |
| 720,783 | 2/1903 | Clough . | |
| 762,039 | 6/1904 | Freel . | |
| 893,469 | 7/1908 | Essmuller | 215/319 |
| 910,383 | 1/1909 | Hudgen . | |
| 928,373 | 7/1909 | Florsheim . | |
| 1,017,362 | 2/1912 | Adams . | |
| 1,243,033 | 10/1917 | Beatty | 229/103.1 X |
| 1,260,380 | 3/1918 | Higuchi . | |
| 1,687,553 | 10/1928 | Friedlander et al. . | |
| 2,050,097 | 8/1936 | Kalenoff . | |
| 2,050,098 | 8/1936 | Kalenoff . | |
| 2,064,411 | 12/1936 | Brandstein | 215/321 |
| 2,080,108 | 5/1937 | Brandstein | 150/52 R |
| 2,266,270 | 12/1941 | Roth | 215/317 |
| 2,461,703 | 2/1949 | Spanel | 150/52 R |
| 2,645,818 | 7/1953 | Drisch et al. . | |
| 2,821,230 | 1/1958 | May | 150/52 R |
| 2,948,453 | 8/1960 | Drown | 215/1 A |
| 2,991,903 | 7/1961 | Weiss . | |
| 3,019,932 | 2/1962 | Singiser | 215/319 X |
| 3,157,304 | 11/1964 | Judge . | |
| 3,169,171 | 2/1965 | Wachs et al. . | |
| 3,301,459 | 1/1967 | Gardner . | |
| 3,655,089 | 4/1972 | Tower | 220/287 |
| 3,773,243 | 11/1973 | Greene | 229/103.1 |
| 3,862,614 | 1/1975 | Kovac | 215/317 |
| 3,901,405 | 8/1975 | Norberg . | |
| 3,962,555 | 6/1976 | Efaw . | |
| 4,542,833 | 9/1985 | DeVaughn . | |

FOREIGN PATENT DOCUMENTS

| | | | |
|---|---|---|---|
| 0036028 | 6/1926 | Denmark | 215/317 |
| 2528676 | 1/1977 | Fed. Rep. of Germany . | |
| 0974761 | 2/1951 | France . | |
| 1012848 | 7/1952 | France | 215/317 |
| 1354584 | 1/1964 | France . | |
| 2457814 | 12/1980 | France . | |
| 543678 | 5/1956 | Italy . | |
| 0726896 | 3/1955 | United Kingdom . | |

OTHER PUBLICATIONS

Packaging, vol. 34, Jul. 1952, (London, GB), "New All-Purpose Jar and Bottle Closures", pp. 40–42.

*Primary Examiner*—Stephen Marcus
*Assistant Examiner*—Nova Stucker
*Attorney, Agent, or Firm*—David H. Judson

[57] ABSTRACT

Methods and apparatus are disclosed for a lid for use in closing container openings on a range of containers having openings of different sizes. One method includes the steps of selecting an elastic material and forming the lid out of the elastic material with a closure panel and a gripping zone along the periphery of the closure panel. The lid is made of a size which is smaller than the smallest size container opening so that the lid is resiliently stretched to be fitted over any of the container openings for the resiliency of the lid to keep it engaged with any of the containers over such an opening. The size of the lid and the elasticity of the material are selected in relation to the anticipated sizes of the openings so that the resiliency of the material of the lid will be sufficient to provide a sealing engagement with any of the containers. The invention further provides a lid constructed in accordance with the above method.

14 Claims, 3 Drawing Sheets

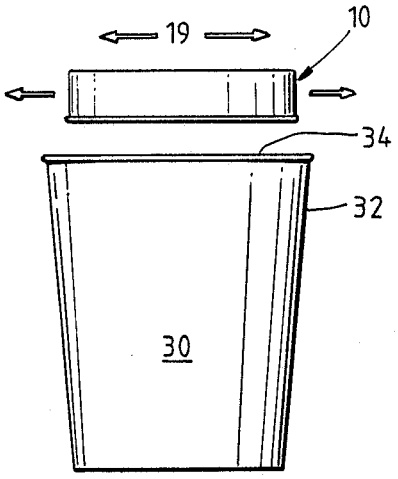
Fig. 7
Fig. 8
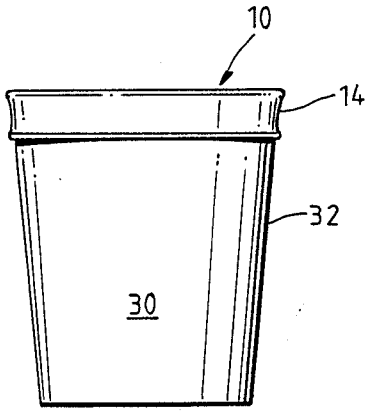
Fig. 9
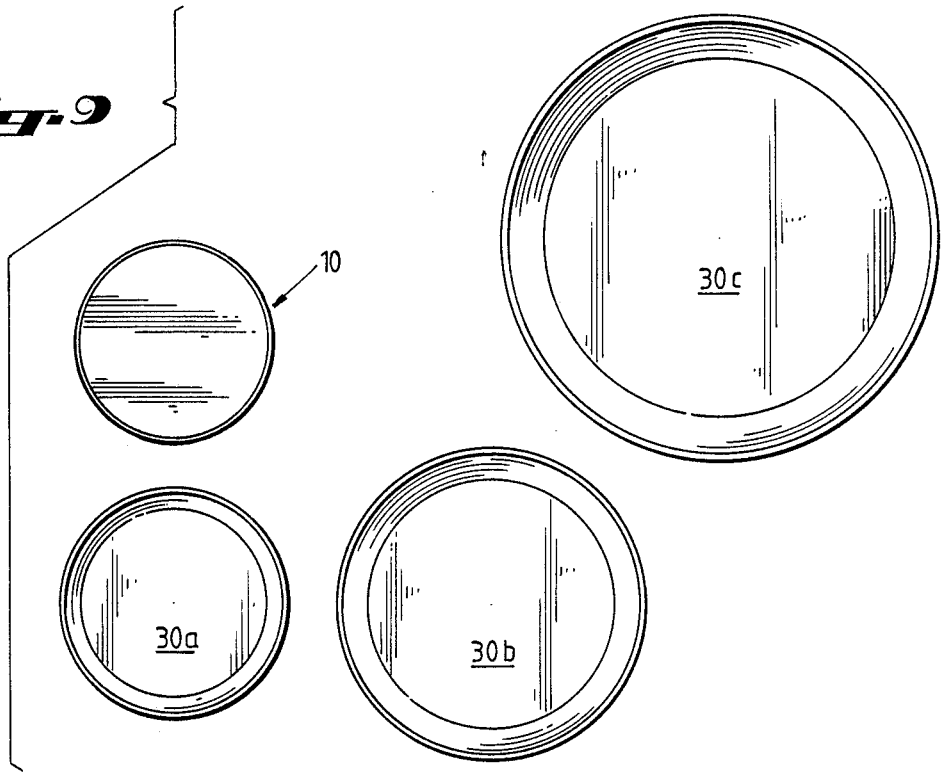

METHOD AND APPARATUS FOR CLOSING CONTAINERS

This is a continuation of co-pending application Ser. No. 107,371, filed on Oct. 9, 1987.

BACKGROUND OF THE INVENTION

The invention relates to closures for containers and more specifically it relates to a method and apparatus for quickly and easily closing containers of various sizes with a single sized closure device. The invention also relates to the handling and dispensing of disposable containers.

Numerous attempts have been made to provide simple and effective lids or other closures for containers. For example, paint cans typically include a concave annular ring into which is fit a lid having a convex annular ring shaped and sized such that the two rings mate to form a seal. While this type of lid provides a sturdy, durable means of closing a paint can, it suffers the disadvantage of allowing the passage of air into the paint if any material becomes trapped between the lid and the can such that a complete seal is prevented. Since paint often collects in the concave annular ring, this type of lid also leads to the splattering of paint when the lid is hammered back into place after painting.

Perhaps the greatest problems with lids are encountered with lids for disposable containers such as cups at convenience stores or fast food restaurants. Since there are a wide variety of sizes of such containers, the convenience store or fast food restaurant must presently stock a wide variety of sizes of lids to correspond with the variously sized openings of the containers. In practice, the selection of the proper lid and the placement of the lid on the container is often time consuming and, when rushed, can lead to improper installation of the lid, and leakage, and even damage to the container.

It is therefore desirable to provide a method and apparatus for closing such containers which is rapid, simple, and which solves the inventory problems presented by current closure devices.

Accordingly, it is an object of this invention to provide a system and a method which can overcome or at least reduce one or more of the disadvantages discussed above.

SUMMARY OF THE INVENTION

Accordingly, the present invention provides a method and apparatus for rapidly and simply closing containers, especially disposable containers such as beverage containers having varying sized openings.

In one embodiment of the present invention, the invention provides a method of providing for the supply of beverages in disposable containers. The method includes the step of providing disposable containers in which some containers have an opening of one size defined by an opening wall and in which some containers have an opening of a different size defined by an opening wall. The method further includes the step of providing lids of a single size for the containers, each lid being of an elastic material which retains its elasticity during use. Each lid comprises a closure panel and a gripping zone along the periphery of the closure panel and is stretchable for engaging the gripping zone with the opening wall of either size opening to seal the opening.

In an alternative method of the present invention, a method of dispensing beverages in containers having a plurality of differently sized openings is provided. The method includes the steps of dispensing a beverage into such a container. Lids of a single size are used for all of the differently sized containers, each lid being of an elastic material which retains its elasticity during use. Each lid has a closure panel with a gripping zone along its periphery. The method includes the step of resiliently stretching such a lid over the container opening, engaging the gripping zone about the opening, and releasing the lid for the resiliency of the lid to engage the lid in position over the container opening.

The present invention also provides an elastic container lid which is stretchably adjustable to cover container openings of known various sizes. The lid is typically made of an elastomeric material—a material which may be stretched to accommodate container openings of various sizes and which at the same time maintains its resiliency such that it will return substantially to its original form after stretching. The lid includes a closure panel to be extended over such an opening. For container openings of known sizes, the closure panel of the lid is sized to be smaller in dimension in an unstretched condition than the smallest of the known container opening sizes so that the closure panel must be stretched to cover the smallest of such known container openings in use. The lid further includes a gripping zone proximate the periphery of the closure panel wherein the lid is stretchable to allow engagement of the gripping zone with an opening wall of the container opening to cause the lid to grip and seal the container opening.

In a preferred aspect of this embodiment of the present invention, the lid further has an aperture in the closure panel for receiving a drinking straw. The aperture is sized to snugly receive such a straw when the closure panel is in a stretched condition.

In an alternative embodiment of the present invention, the closure panel of the lid may have a domed shape in its relaxed position. The domed shape may be sized and provided with an elasticity such that the closure panel will be substantially flat once it is stretched over a container opening in use. The lid may further include a gripping zone either in the form of an annular skirt or in the form of an annular bead around the periphery of the closure panel. In an alternative aspect of the embodiment including an annular skirt extending from the periphery of the closure panel, the annular skirt may further include an annular bead extending from around the periphery of the annular skirt.

In another alternative embodiment of the present invention, the closure panel of the lid may be substantially planar in its relaxed condition and the gripping zone may be in the form of either an annular bead or, alternatively, an annular skirt extending from the closure panel. In the embodiment having an annular skirt, the annular skirt may further include an annular bead around the periphery of the skirt. Moreover, in still another alternative embodiment, the skirt may extend transversely to the closure panel.

Each of the above embodiments of a lid may include an aperture means for receiving a drinking straw wherein the aperture means is sized to snugly receive such a straw when the closure panel is in the stretched position. The aperture means may comprise of a selectively sized hole which is stamped in the closure panel. The aperture means may alternatively comprise a weakened zone adapted to be punched out or removed by the user of the lid upon insertion of the straw.

The present invention also provides a method for making a lid for use in closing container openings on a range of disposable containers having openings of different sizes. The method includes selecting an elastic material and forming the lid out of the elastic material with a closure panel and a gripping zone along the periphery of the closure panel. The lid is made to a size which is smaller than the smallest anticipated container opening size so that the lid must be resiliently stretched to be fitted over any of the container openings for the resiliency of the lid to keep it engaged with any of the containers over such an opening. The size of the lid and elasticity of the material are further selected in relation to the sizes of the openings and the crush strength of the container walls defining the container openings so that the resiliency or strength of the material of the lid will be sufficient to provide a sealing engagement with any of the selected disposable containers, but will be low enough to avoid crushing of the containers having the largest opening sizes when the lid is mounted onto the container. The method may further include the steps of making the lid in any of the shapes or with any of the features described above and below for such lids.

In a preferred embodiment of a lid made in accordance with the above method, an elastic container lid is provided which is stretchably adjustable to cover disposable container openings having a maximum linear cross-sectional dimension ranging from approximately three inches to approximately six inches. The opening of each such container is defined by an opening wall of the container. The containers have a known or readily determined crush strength at the container opening. The lid is made of an elastomeric material which substantially retains it resiliency during use and includes a closure panel size to be stretchable over such a range of openings. The closure panel is sized to be smaller in dimension in an unstretched condition than the smallest of such container openings sizes so that the closure panel must be stretched to cover the smallest of such container openings in use. The lid further includes a gripping zone proximate the periphery of the closure panel which gripping zone is attached to the closure panel so that the lid is stretchable for engaging the gripping zone with such an opening wall to seal such a container. The closure panel and gripping zone are selected of an elastomeric material having a strength great enough when stretched to cover a container opening to grip the opening walls without exceeding the crush strength of the container at the container opening. Accordingly, a lid is provided which seals the opening of the container without crushing the disposable container inwardly in use.

In a preferred aspect of this embodiment of a lid, the closure panel of the lid is made of latex rubber having a thickness ranging from approximately two thousandths of an inch to approximately eight thousandths of an inch. In the most preferred aspect of this embodiment, the closure panel has a substantially circular shape having a diameter of approximately 2 to 2-½inches.

In a still more preferred embodiment of the present invention, the lid further includes an annular skirt made of the same material as the closure panel and having a width of approximately one-eighth of an inch to approximately ½ inch. The skirt extends transversely to the closure panel and further includes an annular bead around the periphery of the annular skirt.

In yet still another embodiment of the present invention, a container for holding liquids or solids is provided. The container has an opening defined by an opening wall and has a lid removably mounted over the opening to seal the container. The lid is of an elastomeric material and comprises a closure panel and a gripping zone along the periphery of the closure panel. The lid is resiliently stretched over the opening with the gripping zone engaged with the opening wall such that the resiliency of the lid holds the lid in sealing engagement with the container.

Accordingly, the present invention overcomes the previously discussed problems by providing a lid which may be utilized with a variety of differently sized containers and may be easily and quickly applied to such containers. Moreover, because of the adjustability of the lid of the present invention, the lid solves the previously discussed inventory problems by providing a single, easily stored lid which fits all anticipated sizes of cups.

The present invention further overcomes the previously discussed problems by providing a method of providing for the supply of beverages and disposable containers and a method of dispensing beverages and containers having a plurality of differently sized openings which simplifies and expedites the handling of such containers and dispensing such beverages. By using lids of a single size for all of the anticipated containers and by resiliently stretching the lid outwardly to cover the container, the methods of providing for the supply of beverages in differently sized disposable containers and for dispensing beverages and containers having a plurality of different opening sizes provided by the present invention simplifies the process of sealing such containers, whether done by the public or by the entity selling such beverages.

BRIEF DESCRIPTION OF THE DRAWINGS

This invention will be further illustrated by reference to the appended drawings which illustrate particular preferred embodiments of the lid and container constructed in accordance with the present invention.

FIG. 2 is also a top view of the lid shown in FIGS. 3–6;

FIG. 7 is a side view of a container and lid constructed in accordance with the present invention in which the lid is shown in an unstretched position before application to the container;

FIG. 8 is a side view of the container shown in FIG. 7 with the lid stretched and installed in place on the container;

FIG. 9 is a plan view of a lid of the present invention and three differently sized containers illustrating the relative dimension of the lid in relation to such differently sized containers;

DETAILED DESCRIPTION OF PREFERRED EMBODIMENTS

The basic concept of the present invention is the provision of a lid which is made of an elastomeric material or other material that is resiliently stretchable to fit a fairly wide range of container openings. The primary application for such a lid is for closing the disposable cups typically found in fast food restaurants and in convenience stores. For these uses, since the lid is a "one-size-fits-all" lid, the lid solves the significant inventory problems which such businesses face. For fast food restaurants, the lid further offers the advantage of being easily applied to a disposable cup, thereby simplifying and expediting the process of handling beverages at the restaurants.

It has been found, however, that such a lid has other applications. For example, the lid may be used for a variety of sizes of food and beverage containers such as TUPPERWARE containers. The lid is also suitable for providing a quick, overnight seal for paint cans once the conventional cans have been opened. These and other advantages provided by the methods and apparatus of the present invention will become more apparent in view of the following disclosure.

Figure 1:
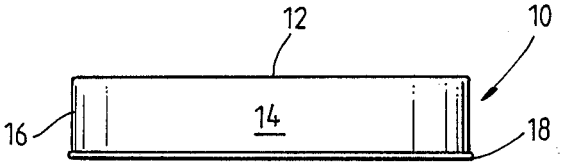
FIG. 1 is a side view of the preferred embodiment of a lid constructed according to the present invention.
Figure 2:
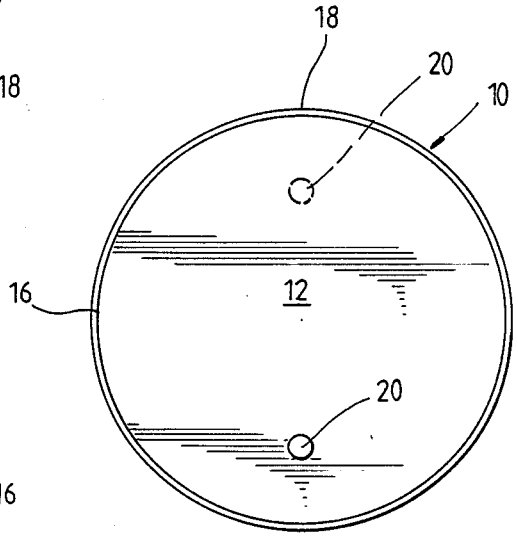
FIG. 2 is a top view of the lid shown in FIG. 1.

Referring now to FIGS. 1 and 2, the preferred embodiment of the present invention is shown. The lid 10 includes a closure panel 12 and a gripping zone 14 located along the periphery of the closure panel 12. The lid may be made of a number of materials which are resiliently stretchable to provide adjustability of the lid to cover a selected range of container openings. Since the lid 10 is affixed to a container utilizing the resiliency of the lid to draw the lid around the container, the closure panel is typically selected to be smaller in dimension in an unstretched condition than the smallest of the anticipated container opening sizes so that the closure panel must be stretched to cover the smallest of such known container openings in use.

In turn, the gripping zone !4 must also be outwardly adjustable to surround the container walls which define a container opening. The gripping zone 14, therefore, is also typically made of a material which is resiliently stretchable such that the gripping panel may be stretched outwardly to surround a container wall and such that the gripping zone will tend to contract to an unstretched position to engage the container wall and hold the lid to the container.

Accordingly, the lid 10 may be made of an elastomeric material having the property of being resiliently stretchable for the anticipated range of lids. In the preferred embodiment, the closure panel 12 and gripping zone 14 are typically comprised of an elastomeric material. In a presently most preferred embodiment, the lid is comprised of a latex material which is commonly called Natural Rubber Latex or Hevea Latex which has a chemical designation of CIS-1,4 polyisoprene.

Referring again to FIGS. 1–6, the closure panel 12 and gripping zone 14 may be formed in a number of shapes. In the preferred embodiment shown in FIGS. 1 and 2, the closure panel 12 has a substantially circular cross-section. The gripping zone includes an annular skirt 16 extending transversely to the closure panel 12. The gripping zone further includes an annular bead 18 disposed around the periphery of the annular skirt 16 to further reinforce the gripping aspect of the gripping zone. In particular, the annular bead 18 often serves to restrict the outward expansion of the annular skirt 16 and to increase the inward force exerted by the annular skirt 16 on the container walls to ensure suitable gripping by the gripping zone 14 of a container in use. In the preferred embodiment, the annular bead 18 is formed from part of the annular skirt 16 by rolling the edge of the annular skirt 16 to form an annular rib or bead 18 as shown.

Figure 3:
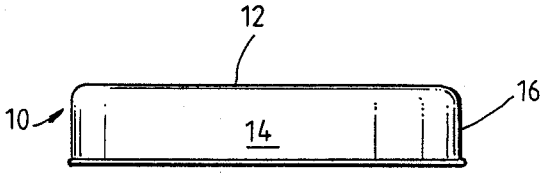
FIG. 3 is a side view of an alternative embodiment of a lid constructed in accordance with the present invention.

Referring now to FIGS. 3–6, there are shown alternative embodiments of a lid 10 constructed in accordance with the present invention. FIG. 3 shows an embodiment in which the definition between the closure panel 12 and the annular skirt 16 is less clearly defined than shown for the preferred embodiment in FIG. 1. That is, the closure panel 12 gently rounds into the annular skirt 16 as shown in FIG. 3.

Figure 4:
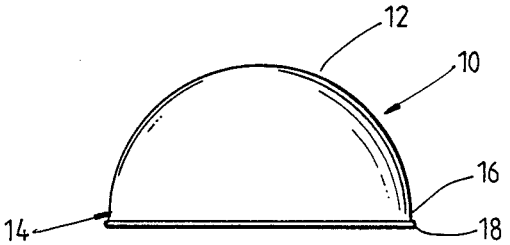
FIG. 4 is a side view of another alternative embodiment of a lid constructed in accordance with the present invention.

Referring now to FIG. 4, the lid may alternatively have a domed shape in the unstretched position. When the embodiment shown in FIG. 4 is used, it has been found that part of the sides of the dome effectively form an annular skirt as designated by 16 when the lid is stretched outwardly over a container opening with the remaining portion of the lid forming the closure panel as designated by 12. In turn, the stretching of the lid 10 to cover container openings typically flattens the closure panel 12 such that the closure panel is substantially planar in the stretched condition despite its domed shape in the relaxed condition.

Figure 5:
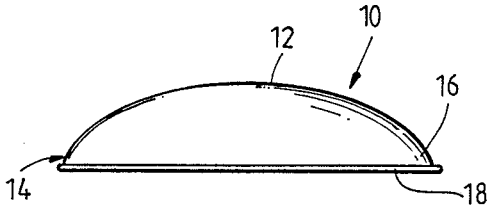
FIG. 5 is a side view of another alternative embodiment of a lid constructed in accordance with the present invention.

FIG. 5 shows a variation of the domed shape lid shown in FIG. 4. In the embodiment shown in FIG. 5, less of the walls of the dome will form a gripping zone and the majority of the dome will form the closure panel 12.

Figure 6:
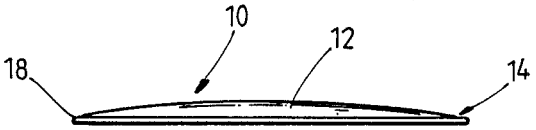
FIG. 6 is a side view of another alternative embodiment of a lid constructed in accordance with the present invention.

In the embodiment shown in FIG. 6, the gripping zone is effectively represented by the annular bead 18.

Hence, in accordance with the present invention, the gripping zone of the lid 10 may be formed to either of an annular skirt, or an annular bead, or may include both an annular skirt and an annular bead. Moreover, the gripping zone 14 may extend transversely from the closure zone 12 as shown in FIG. 1 or may simply extend from the periphery of the closure panel 12 as shown in FIGS. 4 and 5.

Referring now to FIGS. 7 and 8, the container constructed in accordance with the present invention is shown. The container 30 may comprise any of a number of known containers for holding solid or liquid materials. In the preferred embodiment, the container is typically comprised of a disposable cup such as found in fast food restaurants or in convenience store locations. The container 30 includes a lid 10 which is resiliently stretched over the container opening such that the gripping zone 14 of the lid 10 is engaged with a container wall 32 defining a container opening 34 at the top of the container 30. The lid 10 is resiliently stretched over the container opening 34 and the lid is released so that the resiliency of the lid 10 engages the lid in position over the container opening 34.

The present invention also provides a method for supplying beverages and disposable containers. The method includes the steps of providing disposable containers 30 in which some containers have an opening 34 of one size defined by an opening wall 32 and in which some containers have an opening 34 of a different size defined by an opening wall 32. The method further includes the step of providing lids 10 of a single size for the containers, with each lid being of an elastic material which retains its elasticity during use and each lid comprising a closure panel 12 and a gripping zone 14 along the periphery of the closure panel wherein the lid is stretchable for engaging the gripping zone with the opening wall of either size opening to seal the opening.

In yet another method of the present invention, a method of dispensing beverages and container having a plurality of differently sized openings is provided. Referring to FIGS. 7 and 8, the method includes the steps of dispensing a beverage into such a container 30, using lids of a single size for all of the containers, each lid being of an elastic material which retains its elasticity during use. Each lid 10 has a closure panel 12 with a gripping zone 14 along its periphery. The method further includes the step of resiliently stretching such a lid 10 as shown in FIG. 7 outwardly over the container opening, engaging the gripping zone 14 about the opening as shown in FIG. 8, and releasing the resiliency of the lid 10 to engage the lid 10 in position over the container opening 34.

The present invention still further provides a method of making a lid for use in closing container openings on a range of disposable containers having openings of different sizes wherein the container openings are defined by a container wall. The method comprises the steps of selecting an elastic material and forming the lid out of the elastic material with a closure panel 12 and a gripping zone 14 along the periphery of the closure panel 12. The lid is made of a size smaller than the smallest anticipated container opening size so that the lid 10 must be resiliently stretched to be fitted over any container openings 34 for the resiliency of the lid 10 to keep it engaged with any of the containers 30 over such an opening 34. In this method, the size of the lid and the elasticity of the material are selected in relation to the sizes of the openings and the crush strength of the container walls so that the elasticity or resiliency of the material of the lid will be sufficient to provide the sealing engagement of the lid with any of the disposable containers. At the same time, the inward force exerted by the resiliency of elasticity of the lid must not be so great as to cause crushing of the containers when the lid is mounted onto the container.

In the preferred embodiment, the lid is adapted for use with disposable containers typically found in fast food restaurants and convenience stores. It has been found that the anticipated sizes for such containers range from approximately three inches to approximately six inches. The closure panel 12 of the lid is then selected to be approximately two and one-half inches in diameter such that the lid must be stretched approximately one-half inch to cover the smallest container and must be stretched approximately three and one-half inches to cover the largest container. Referring to FIGS. 1 and 2, in the preferred embodiment, the annular skirt 16 has a width of approximately one fourth inch and the annular skirt 16 includes an annular bead 18 which is a rolled rib around the periphery of the annular skirt 16. As stated above, the lid is comprised of natural rubber latex or Hevea latex having a chemical designation of CIS-1,4 polyisoprene. It has been found that lids having a thickness of two thousandths (0.002) of an inch to eight thousandths (0.008) of an inch would provide the requisite elasticity, and strength to expand to cover the selected container sizes (a representation of which are shown in FIG. 9 as containers 30 *a–c*), without crushing the disposable containers.

Referring again to FIG. 2, each of the lids shown in FIGS. 1–6 may further include an aperture means for receiving a drinking straw. As shown in FIG. 2, the aperture means 20 may either include a hole stamped into the lid which is sized to snugly receive such a straw when the closure panel 12 is in a stretched position. The aperture means may alternatively include a weakened or perforated portion (as shown by the dashed line) which may be removed by the user of the lid when inserting the straw. In either case, the aperture means is preferably sized to snugly receive the straw when the closure panel is stretched in order to minimize leakage of fluid from the beverage container when the straw is inserted.

Figure 10:
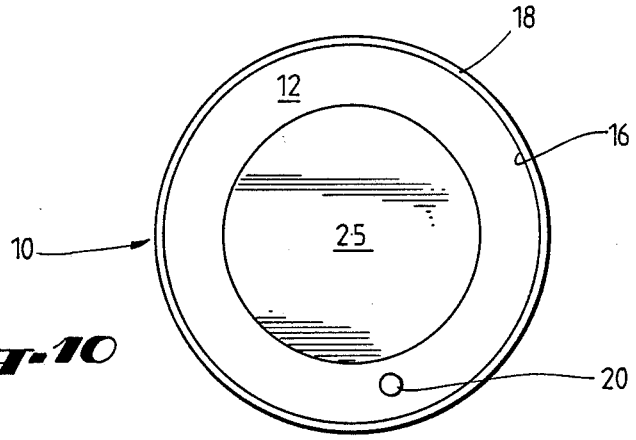
FIG. 10 is a top view of a lid constructed in accordance with the present invention in which only the periphery of the closure panel of the lid is constructed of elastomeric material.

Referring now to FIG. 10, there is shown an alternative embodiment of the present invention. In the embodiment shown in FIG. 10, the closure panel 12 includes a non-elastic region 25. The non-elastic region 25 may comprise a variety of shapes, including ornamental shapes for displaying trademarks or logos of different businesses. In this embodiment of the present invention, the elasticity or stretch is provided around the periphery of the non-elastic zone 25. It will be appreciated in view of the above disclosure that the non-elastic zone 25 will limit the range of adjustability of the lid 10 shown in FIG. 10.

Figure 11:
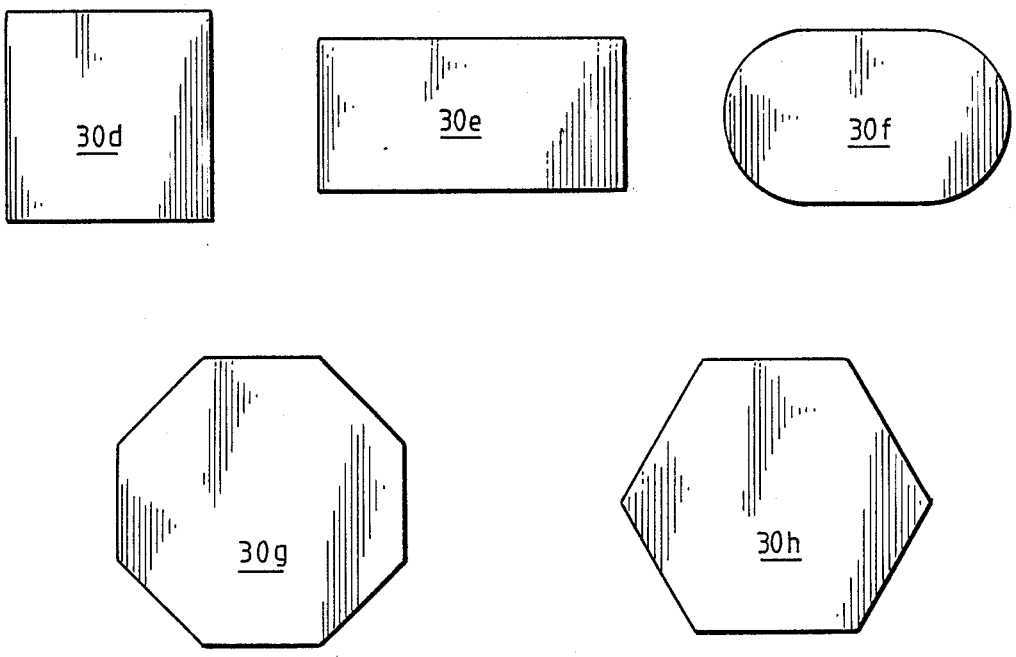
FIG. 11 is a top view of various other container openings which are suitable for use in accordance with the present invention.

The instant invention has been disclosed in connection with specific embodiments. However, it will be apparent to those skilled in the art that variations from the illustrated embodiments may be undertaken without departing from the spirit and scope of the invention. For example, the containers 30 utilized in connection with the present invention may have openings shaped in shapes other than a circle, including ovals, squares, rectangles, and other polygonal configurations such as are shown as containers 30 *d–h* in FIG. 11. Similarly, while the lids shown in FIGS. 1–6 are displayed as being circular in shape, it will also be appreciated that the shapes of the lids may be varied to fit particular container openings (such as are shown in FIG. 11) in accordance with the present invention. Moreover, the methods, system, and lids of the present invention may be utilized for containers for use in a freezer or other cold storage application. These and other variations will be apparent to those skilled in the art and are within the spirit and scope of the present invention.

What is claimed is:

1. An elastic container lid, stretchably adjustable to cover an opening of any of a plurality of disposable non-rigid containers each having a readily deformable opening wall defining a mouth configuration for an opening of the container, each container opening having a diameter ranging from a minimum of approximately three inches to a maximum of approximately six inches, comprising;

a closure panel having a predetermined surface area of approximately two and one-half inches in diameter in an unstretched condition, the closure panel having a predetermined thickness ranging from approximately two-eight thousands (0.002 to 0.008) inches to enable the closure panel to have sufficient elasticity to be stretchable over said maximum container diameter of approximately six inches to cover any of aid container openings;

a gripping zone extending transversely from the periphery of the closure panel, the gripping zone having a width ranging from approximately one-eighth to one-half inches and a thickness ranging from approximately two-eight thousands (0.002 to 0.008) inches, the gripping zone further including an annular bead along the periphery of the gripping zone for engaging the opening wall of any container of the plurality when the closure panel and gripping zone are resiliently stretched over the opening wall of the container, wherein in a stretched condition the closure panel seals the container while leaving the mouth configuration of the container opening substantially undisturbed;

the closure panel and the gripping zone being formed of a latex elastomeric material that substantially retains its resiliency during use.

2. An elastic container lid according to claim 1, in which the closure panel of the lid has a domed shape in its relaxed position.

3. An elastic container lid according to claim 2, in which the closure panel of the lid is substantially flat it its stretched condition.

4. An elastic container lid according to claim 1, in which the closure panel of the lid is substantially planar in its relaxed condition and in which the gripping zone is in the form of an annular skirt extending from the closure panel.

5. An elastic container lid according to claim 4, in which the skirt extends transversely to the closure panel.

6. An elastic container lid according to claim 1, in which the closure panel of the lid includes aperture ;means for receiving a drinking straw, the aperture means being sized to snugly receive such a straw when the closure panel is in a stretched position covering such a container opening.

7. An elastic container lid according to claim 1, in which the annular bead comprises a rolled edge of the lid.

8. A method, using elastomeric lids of a single size each having a closure panel and gripping zone along its periphery, for sealing any of a plurality of non-rigid, disposable containers each having a readily deformable opening wall defining a mouth configuration for an opening of the container, each container opening having a diameter ranging from a minimum of approximately three inches to a maximum of approximately six inches, the closure panel of each lid having a predetermined surface area and thickness to enable the closure panel to be stretchable to cover the opening of any of the plurality of containers, comprising the steps of:

(a) resiliently stretching the closure panel and gripping zone of a first lid over the opening wall of a first container, the first container having an opening of a first diameter;

(b) engaging the gripping zone of the first lid about the opening wall of the first container;

(c) releasing the first lid such that the closure panel in a stretched condition seals the first container while leaving the mouth configuration of the opening of the first container substantially undisturbed; and (d) repeating steps (a)–(c) for a second container using a second lid, the second container having an opening of a second diameter different from the first diameter of the first container.

9. In a combination with a plurality of non-rigid, disposable containers each having a readily deformable opening wall defining a mouth configuration for an opening of the container, each container opening having a diameter ranging from a minimum of approximately three inches to a maximum of approximately six inches, a single size elastomeric lid, comprising:

a closure panel having a predetermined surface area and thickness to enable the closure panel to be stretchable to cover the opening of any of the plurality of containers; and a gripping zone along the periphery of the closure panel for engaging the opening wall of a container when the closure panel and gripping zone are resiliently stretched over the opening wall of the container, wherein in a stretched condition the closure panel seals the container while leaving the mouth configuration of the container opening substantially undisturbed.

10. The combination as described in claim 9 wherein the gripping zone of the elastomeric lid is an annular skirt extending from around the periphery of the closure panel.

11. The combination as described in claim 10 wherein the gripping zone includes an annular bead around the periphery of the annular skirt.

12. The combination as described in claim 9 wherein the gripping zone is an annular bead extending from around the periphery of the closure panel.

13. The combination as described in claim 12 wherein the annular bead comprises a rolled edge of the closure panel.

14. The combination as described in claim 9 wherein the closure panel of the lid includes aperture means for receiving a drinking straw, the aperture means being sized to snugly receive such a straw when the closure panel is in a stretched position.

* * * * *